US007985314B2

(12) United States Patent
Huang

(10) Patent No.: US 7,985,314 B2
(45) **Date of Patent: *Jul. 26, 2011**

(54) METHOD OF MAKING AN ALL-WEATHER GRIP

(76) Inventor: Ben Huang, Huntington Beach, CA (US)

( * ) Notice: Subject to any disclaimer, the term of this patent is extended or adjusted under 35 U.S.C. 154(b) by 373 days.

This patent is subject to a terminal disclaimer.

(21) Appl. No.: 12/123,384

(22) Filed: May 19, 2008

(65) Prior Publication Data

US 2008/0283178 A1 Nov. 20, 2008

Related U.S. Application Data

(60) Continuation of application No. 10/785,379, filed on Feb. 24, 2004, now Pat. No. 7,374,498, which is a division of application No. 10/038,392, filed on Jan. 2, 2002, now Pat. No. 6,695,713, and a continuation-in-part of application No. 09/901,747, filed on Jul. 9, 2001, now abandoned, and a continuation-in-part of application No. 09/705,376, filed on Oct. 30, 2000, now abandoned, which is a continuation-in-part of application No. 09/497,750, filed on Feb. 4, 2000, now Pat. No. 6,386,989.

(51) Int. Cl.

| | |
|---|---|
| ***B29C 70/00*** | (2006.01) |
| ***B32B 29/02*** | (2006.01) |
| ***B65H 81/00*** | (2006.01) |
| ***B32B 37/00*** | (2006.01) |
| ***A63B 53/14*** | (2006.01) |

(52) U.S. Cl. ..... 156/166; 156/153; 156/154; 156/176; 156/178; 156/184; 156/187; 156/244.11; 156/244.12; 473/300; 473/301

(58) Field of Classification Search ..... 156/153–154, 156/184–185, 187–188, 190–192, 195, 278, 156/289, 166, 176, 178, 244.11, 244.12; 473/300–303

See application file for complete search history.

(56) References Cited

U.S. PATENT DOCUMENTS

| | | | |
|---|---|---|---|
| 571,025 | A | 11/1896 | Spamer |
| 834,711 | A | 10/1906 | Clarke et al. |
| 979,266 | A | 12/1910 | Dean |
| 1,008,604 | A | 11/1911 | Lake |
| 1,017,565 | A | 2/1912 | Lard |

(Continued)

FOREIGN PATENT DOCUMENTS

| | | | |
|---|---|---|---|
| CN | 2139008 | Y | 7/1993 |

(Continued)

OTHER PUBLICATIONS

The Random House College Dictionary, Revised Edition, 1975, p. 1233, definition of skive.

(Continued)

*Primary Examiner* — Khanh Nguyen
*Assistant Examiner* — Carson Gross
(74) *Attorney, Agent, or Firm* — Knobbe Martens Olson & Bear LLP

(57) ABSTRACT

A slip-resistant shock absorbing golf club grip that includes a felt layer, a fabric mesh formed of fibers and a polyurethane coating covering the mesh and felt, the fibers of the mesh defining grooves in the surface of the slip-resistant polyurethane which are engaged by a users' hands, with the polyurethane coating being buffed to partially expose the fibers.

7 Claims, 8 Drawing Sheets

U.S. PATENT DOCUMENTS

| | | | | | |
|---|---|---|---|---|---|
| 1,139,843 | A | | 5/1915 | Brown | |
| 1,345,505 | A | | 7/1920 | Persons | |
| 1,435,088 | A | | 11/1922 | Smith | |
| 1,522,635 | A | | 1/1925 | Kraeuter | |
| 1,528,190 | A | | 3/1925 | Howe | |
| 1,617,972 | A | | 2/1927 | Wallace | |
| 1,890,037 | A | | 11/1930 | Johnson | |
| 1,943,399 | A | | 1/1934 | Smith | |
| 2,000,295 | A | | 5/1935 | Oldham | |
| 2,086,062 | A | | 7/1937 | Bray | |
| 2,103,889 | A | | 12/1937 | Brisick | |
| 2,149,911 | A | | 3/1939 | East | |
| 2,206,056 | A | | 7/1940 | Sheesley | |
| 2,221,421 | A | | 11/1940 | Curry | |
| 2,449,575 | A | | 9/1948 | Wilhelm | |
| 2,523,637 | A | | 9/1950 | Stanfield et al. | |
| 2,671,660 | A | | 3/1954 | Goodwin | |
| 2,690,338 | A | | 9/1954 | Brocke | |
| 2,772,090 | A | | 11/1956 | Brandon | |
| 2,934,285 | A | | 4/1960 | Niehaus | |
| 2,984,486 | A | | 5/1961 | Jones | |
| 3,028,283 | A | | 4/1962 | Lundgren et al. | |
| 3,059,816 | A | | 10/1962 | Goldstein | |
| 3,073,055 | A | | 1/1963 | Edwards et al. | |
| 3,087,729 | A | | 4/1963 | Sullivan | |
| 3,095,198 | A | | 6/1963 | Gasche | |
| 3,140,873 | A | | 7/1964 | Goodwin | |
| 3,157,723 | A | | 11/1964 | Hochberg | |
| 3,311,375 | A | | 3/1967 | Onions | |
| 3,366,384 | A | | 1/1968 | Lamkin et al. | |
| 3,368,811 | A | | 2/1968 | Finney | |
| 3,503,784 | A | | 3/1970 | Okayama et al. | |
| 3,606,325 | A | | 9/1971 | Lamkin et al. | |
| 3,697,315 | A | * | 10/1972 | Mine | 442/60 |
| 3,857,745 | A | | 12/1974 | Grausch et al. | |
| 3,876,320 | A | | 4/1975 | Phillipson | |
| 3,922,402 | A | | 11/1975 | Shimamura et al. | |
| 3,973,348 | A | | 8/1976 | Shell | |
| 3,992,021 | A | | 11/1976 | Tobin | |
| 4,012,039 | A | | 3/1977 | Yerke | |
| 4,015,851 | A | | 4/1977 | Pennell | |
| 4,052,061 | A | | 10/1977 | Stewart | |
| 4,133,529 | A | | 1/1979 | Gambino | |
| 4,137,360 | A | | 1/1979 | Reischl | |
| 4,216,251 | A | | 8/1980 | Nishimura et al. | |
| 4,284,275 | A | | 8/1981 | Fletcher | |
| 4,347,280 | A | | 8/1982 | Lau et al. | |
| 4,358,499 | A | | 11/1982 | Hill | |
| 4,373,718 | A | | 2/1983 | Schmidt | |
| 4,448,922 | A | | 5/1984 | McCartney | |
| 4,535,649 | A | | 8/1985 | Stahel | |
| 4,613,537 | A | * | 9/1986 | Krupper | 428/192 |
| 4,651,991 | A | | 3/1987 | McDuff | |
| 4,662,415 | A | | 5/1987 | Proutt | |
| 4,765,856 | A | | 8/1988 | Doubt | |
| 4,878,667 | A | | 11/1989 | Tosti | |
| 4,919,420 | A | * | 4/1990 | Sato | 473/203 |
| 4,941,232 | A | | 7/1990 | Decker et al. | |
| 4,971,837 | A | | 11/1990 | Martz et al. | |
| 5,024,866 | A | | 6/1991 | Goode | |
| 5,055,340 | A | | 10/1991 | Matsumura et al. | |
| 5,118,107 | A | | 6/1992 | Bucher | |
| 5,123,646 | A | | 6/1992 | Overby et al. | |
| 5,127,650 | A | | 7/1992 | Schneller | |
| 5,261,665 | A | | 11/1993 | Downey | |
| 5,322,290 | A | | 6/1994 | Minami | |
| 5,343,776 | A | | 9/1994 | Falco et al. | |
| 5,374,059 | A | | 12/1994 | Huang | |
| 5,396,727 | A | | 3/1995 | Furuya et al. | |
| 5,427,376 | A | | 6/1995 | Cummings et al. | |
| 5,469,601 | A | | 11/1995 | Jackson | |
| 5,474,802 | A | | 12/1995 | Shimoda et al. | |
| 5,480,146 | A | | 1/1996 | Comer | |
| 5,485,996 | A | | 1/1996 | Niksich | |
| 5,511,445 | A | | 4/1996 | Hildebrandt | |
| 5,537,773 | A | | 7/1996 | Matsubara et al. | |
| 5,570,884 | A | | 11/1996 | Carps | |
| 5,571,050 | A | | 11/1996 | Huang | |
| 5,577,722 | A | | 11/1996 | Glassberg | |
| 5,584,482 | A | | 12/1996 | Huang | |
| 5,595,544 | A | | 1/1997 | Roelke | |
| 5,611,533 | A | | 3/1997 | Williams | |
| 5,624,116 | A | | 4/1997 | Yeh | |
| 5,626,527 | A | | 5/1997 | Eberlein | |
| 5,634,859 | A | | 6/1997 | Nesbitt | |
| 5,645,501 | A | | 7/1997 | Huang | |
| 5,671,923 | A | * | 9/1997 | Huang | 273/301 |
| 5,690,566 | A | | 11/1997 | Bracho | |
| 5,695,418 | A | | 12/1997 | Huang | |
| 5,730,662 | A | | 3/1998 | Rens | |
| 5,730,669 | A | | 3/1998 | Huang | |
| 5,753,568 | A | * | 5/1998 | Shimano et al. | 442/64 |
| 5,772,524 | A | | 6/1998 | Huang | |
| 5,781,963 | A | | 7/1998 | Maru et al. | |
| 5,797,813 | A | | 8/1998 | Huang | |
| 5,803,828 | A | | 9/1998 | Huang | |
| 5,813,921 | A | | 9/1998 | Huang | |
| 5,816,933 | A | | 10/1998 | Huang | |
| 5,816,934 | A | * | 10/1998 | Huang | 473/301 |
| 5,827,129 | A | | 10/1998 | Huang | |
| 5,851,632 | A | | 12/1998 | Chen et al. | |
| 5,857,929 | A | | 1/1999 | Huang | |
| 5,867,868 | A | | 2/1999 | Ward | |
| 5,890,260 | A | | 4/1999 | Gaunt | |
| 5,890,972 | A | | 4/1999 | Huang | |
| 5,895,329 | A | | 4/1999 | Huang | |
| 5,910,054 | A | * | 6/1999 | Huang | 473/302 |
| 5,924,941 | A | | 7/1999 | Hagey | |
| 5,997,421 | A | | 12/1999 | Huang | |
| 6,036,607 | A | | 3/2000 | Finegan | |
| 6,048,275 | A | | 4/2000 | Gedeon | |
| 6,197,392 | B1 | | 3/2001 | Jones | |
| 6,226,836 | B1 | | 5/2001 | Yasui | |
| 6,244,975 | B1 | | 6/2001 | Huang | |
| 6,261,191 | B1 | | 7/2001 | Chen | |
| 6,314,617 | B1 | | 11/2001 | Hastings | |
| 6,360,475 | B1 | | 3/2002 | Lepage et al. | |
| 6,361,450 | B1 | | 3/2002 | Huang | |
| 6,386,989 | B1 | | 5/2002 | Huang | |
| 6,449,803 | B1 | | 9/2002 | McConchie | |
| 6,503,153 | B2 | | 1/2003 | Wang | |
| 6,506,128 | B1 | | 1/2003 | Bloom, Jr. | |
| 6,511,732 | B1 | | 1/2003 | Chao | |
| 6,551,198 | B2 | | 4/2003 | Huang | |
| 6,558,270 | B2 | | 5/2003 | Kwitek | |
| 6,627,027 | B2 | | 9/2003 | Huang | |
| 6,629,901 | B2 | | 10/2003 | Huang | |
| 6,635,688 | B2 | | 10/2003 | Simpson | |
| 6,652,398 | B2 | | 11/2003 | Falone et al. | |
| 6,656,054 | B2 | | 12/2003 | Ulrich | |
| 6,656,057 | B2 | | 12/2003 | Manual et al. | |
| 6,663,500 | B2 | | 12/2003 | Huang | |
| 6,666,777 | B1 | | 12/2003 | Lamkin et al. | |
| 6,676,534 | B2 | | 1/2004 | Huang | |
| 6,695,713 | B2 | * | 2/2004 | Huang | 473/301 |
| 6,709,346 | B1 | | 3/2004 | Wang | |
| 6,733,401 | B1 | | 5/2004 | Huang | |
| 6,827,656 | B1 | | 12/2004 | Hoeflich et al. | |
| 6,843,732 | B1 | | 1/2005 | Huang | |
| 6,857,971 | B2 | | 2/2005 | Huang | |
| 6,908,400 | B2 | | 6/2005 | Chu et al. | |
| 6,973,750 | B1 | | 12/2005 | Kim | |
| 6,974,626 | B2 | | 12/2005 | Horacek | |
| 7,008,582 | B2 | | 3/2006 | Chen | |
| 7,048,644 | B2 | | 5/2006 | Wang | |
| 7,137,904 | B2 | | 11/2006 | Huang | |
| 7,140,973 | B2 | | 11/2006 | Rohrer | |
| 7,186,189 | B2 | | 3/2007 | Huang | |
| 7,195,568 | B2 | | 3/2007 | Huang | |
| 7,219,395 | B2 | | 5/2007 | Bigolin | |
| 7,344,448 | B2 | | 3/2008 | Huang | |
| 7,347,792 | B2 | | 3/2008 | Huang | |
| 7,374,498 | B2 | | 5/2008 | Huang | |
| 7,404,770 | B2 | | 7/2008 | Huang | |
| 7,438,646 | B2 | | 10/2008 | Huang | |
| 7,448,957 | B2 | | 11/2008 | Huang | |
| 7,448,958 | B2 | | 11/2008 | Huang | |

| | | | |
|---|---|---|---|
| 7,470,199 | B2 | 12/2008 | Huang |
| 7,491,133 | B2 | 2/2009 | Huang |
| 7,527,564 | B2 | 5/2009 | Huang |
| 7,566,375 | B2 | 7/2009 | Huang |
| 7,585,230 | B2 | 9/2009 | Huang |
| 7,770,321 | B2 | 8/2010 | Huang |
| 2002/0028325 | A1 | 3/2002 | Simpson |
| 2002/0142900 | A1 | 10/2002 | Wang |
| 2002/0151373 | A1 | 10/2002 | Beauregard |
| 2002/0173371 | A1 | 11/2002 | Lamkin et al. |
| 2003/0040384 | A1 | 2/2003 | Falone et al. |
| 2003/0045370 | A1 | 3/2003 | Jaw |
| 2003/0062654 | A1 | 4/2003 | Lamkin |
| 2003/0139223 | A1 | 7/2003 | Ulrich et al. |
| 2003/0148836 | A1 | 8/2003 | Falone et al. |
| 2003/0150081 | A1 | 8/2003 | Wang |
| 2003/0216192 | A1 | 11/2003 | Chu |
| 2003/0228930 | A1 | 12/2003 | Huang |
| 2004/0029645 | A1 | 2/2004 | Chen |
| 2004/0029646 | A1 | 2/2004 | Chu et al. |
| 2004/0031128 | A1 | 2/2004 | Chen |
| 2004/0109980 | A1 | 6/2004 | Chen et al. |
| 2004/0123429 | A1 | 7/2004 | Wang |
| 2004/0185958 | A1 | 9/2004 | Huang |
| 2004/0266546 | A1 | 12/2004 | Huang |
| 2005/0229285 | A1 | 10/2005 | Chung |
| 2005/0276925 | A1 | 12/2005 | Su |
| 2005/0287329 | A1 | 12/2005 | Lai |
| 2006/0172815 | A1 | 8/2006 | Chu |
| 2006/0252571 | A1 | 11/2006 | Wang |
| 2006/0264268 | A1 | 11/2006 | Huang |
| 2006/0287123 | A1 | 12/2006 | Wang |
| 2007/0149307 | A1 | 6/2007 | Huang |
| 2008/0120893 | A1 | 5/2008 | Keys et al. |
| 2009/0025852 | A1 | 1/2009 | Huang |
| 2009/0048036 | A1 | 2/2009 | Huang |
| 2009/0258721 | A1 | 10/2009 | Huang |
| 2010/0022322 | A1 | 1/2010 | Huang |

FOREIGN PATENT DOCUMENTS

| | | | | |
|---|---|---|---|---|
| CN | 2163667 | Y | | 5/1994 |
| CN | 2288744 | | | 8/1998 |
| CN | 2438768 | | | 7/2001 |
| CN | 2444645 | | | 8/2001 |
| CN | 1332022 | A | | 1/2002 |
| CN | 02254450 X | | | 9/2002 |
| CN | 2596752 | | * | 1/2004 |
| CN | 2659497 | | * | 12/2004 |
| DE | 36 44 674 | A1 | | 7/1988 |
| DE | 92 18 550 | U1 | * | 8/1994 |
| EP | 1 371 397 | | | 12/2003 |
| FR | 2 731 402 | | | 9/1996 |
| GB | 2 192 550 | A | | 1/1988 |
| JP | 55-43008 | | | 3/1980 |
| JP | 7-41731 | | | 2/1995 |
| JP | 3081404 | | | 8/2001 |
| JP | 2002-028264 | | | 1/2002 |

OTHER PUBLICATIONS

U.S. Appl. No. 11/029,328, filed Jan. 5, 2005, Abandoned.
U.S. Appl. No. 10/875,035, filed Jun. 23, 2004, pending.
U.S. Appl. No. 11/062,046, filed Feb. 18, 2005, pending.
U.S. Appl. No. 11/131,832, filed May 18, 2005, pending.
U.S. Appl. No. 11/417,401, filed May 3, 2006, pending.
U.S. Appl. No. 11/417,555, filed May 3, 2006, pending.
U.S. Appl. No. 11/417,623, filed May 3, 2006, pending.
U.S. Appl. No. 11/417,643, filed May 3, 2006, pending.
U.S. Appl. No. 11/417,696, filed May 3, 2006, pending.
U.S. Appl. No. 11/682,264, filed Mar. 5, 2007, pending.
U.S. Appl. No. 11/689,452, filed Mar. 21, 2007 pending.
U.S. Appl. No. 11/838,670, filed Aug. 17, 2007, pending.
U.S. Appl. No. 12/045,639, filed Mar. 10, 2008 pending.
U.S. Appl. No. 12/753,804, filed Apr. 2, 2010, pending.
U.S. Appl. No. 12/753,669, filed Apr. 2, 2010, pending.
U.S. Appl. No. 12/753,799, filed Apr. 2, 2010, pending.
U.S. Appl. No. 12/753,773, filed Apr. 2, 2010, pending.
U.S. Appl. No. 12/767,736, filed Apr. 26, 2010, pending.
U.S. Appl. No. 12/848,052, filed Jul. 30, 2010, pending.
U.S. Appl. No. 12/862,673, filed Aug. 24, 2010, pending.
U.S. Appl. No. 12/948,637, filed Nov. 17, 2010, pending.
U.S. Appl. No. 12/960,261, filed Dec. 3, 2010, pending.

* cited by examiner

FIG. 1
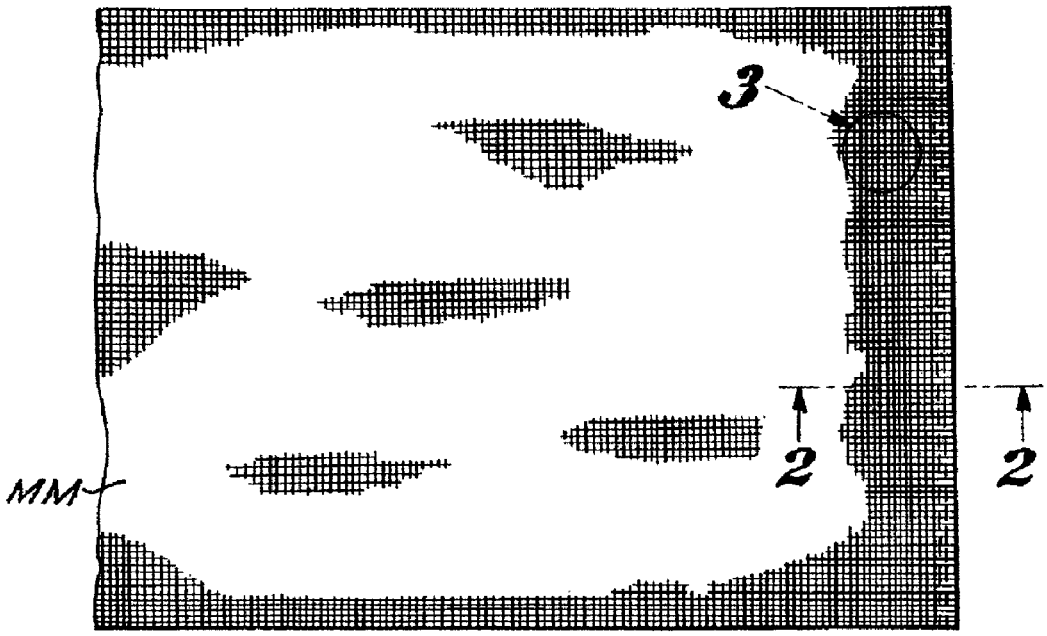
FIG. 2
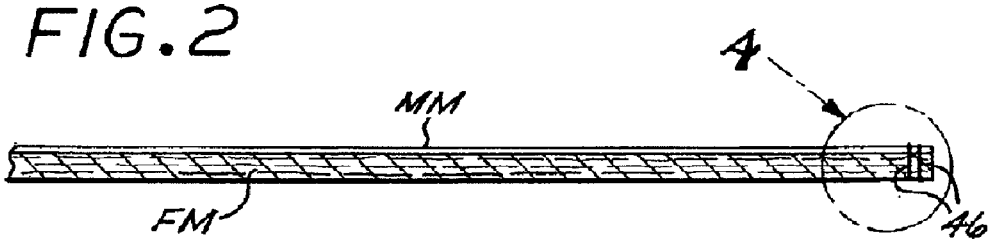
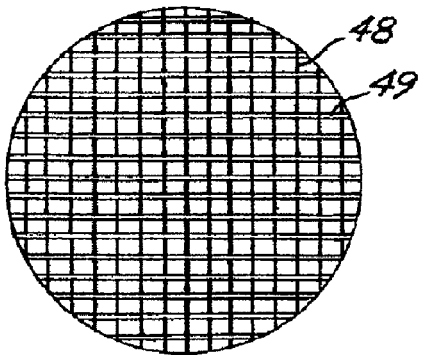
FIG. 3
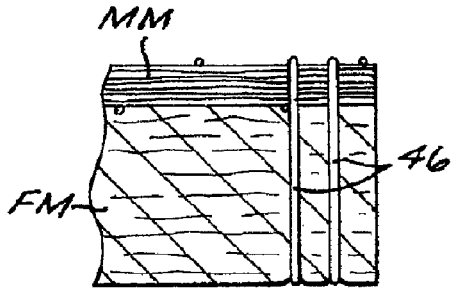
FIG. 4

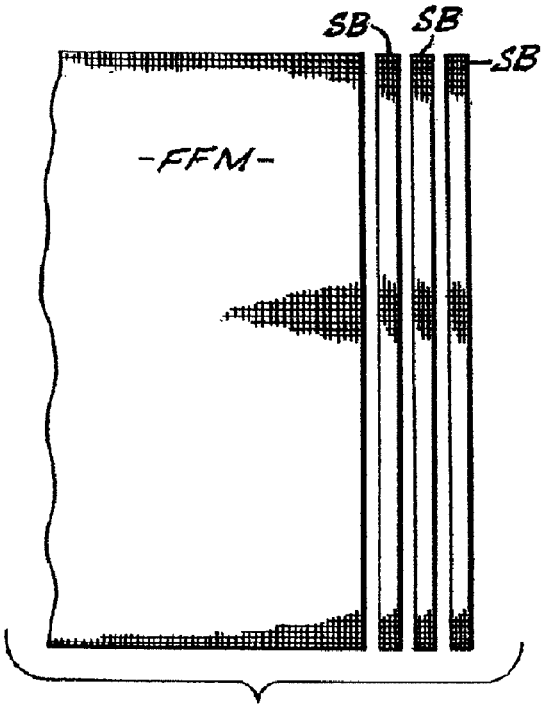
FIG. 9
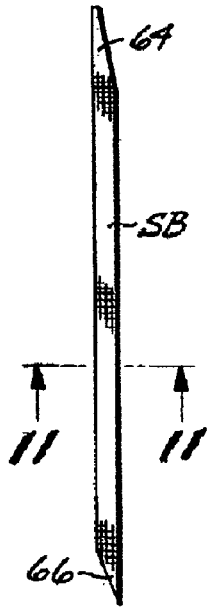
FIG. 10
FIG. 11
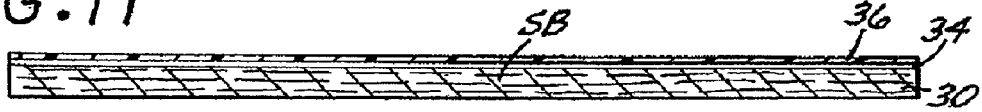
FIG. 12
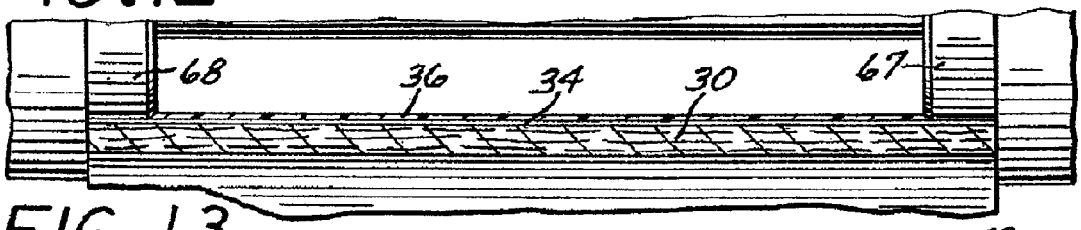
FIG. 13
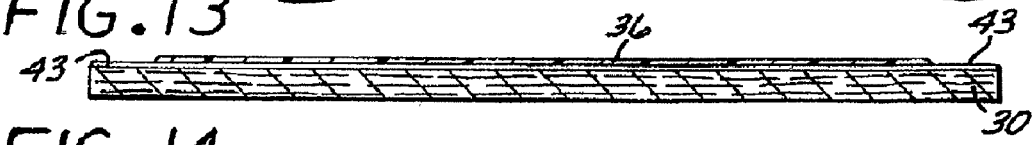
FIG. 14
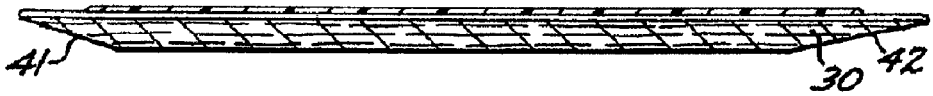

FIG. 23
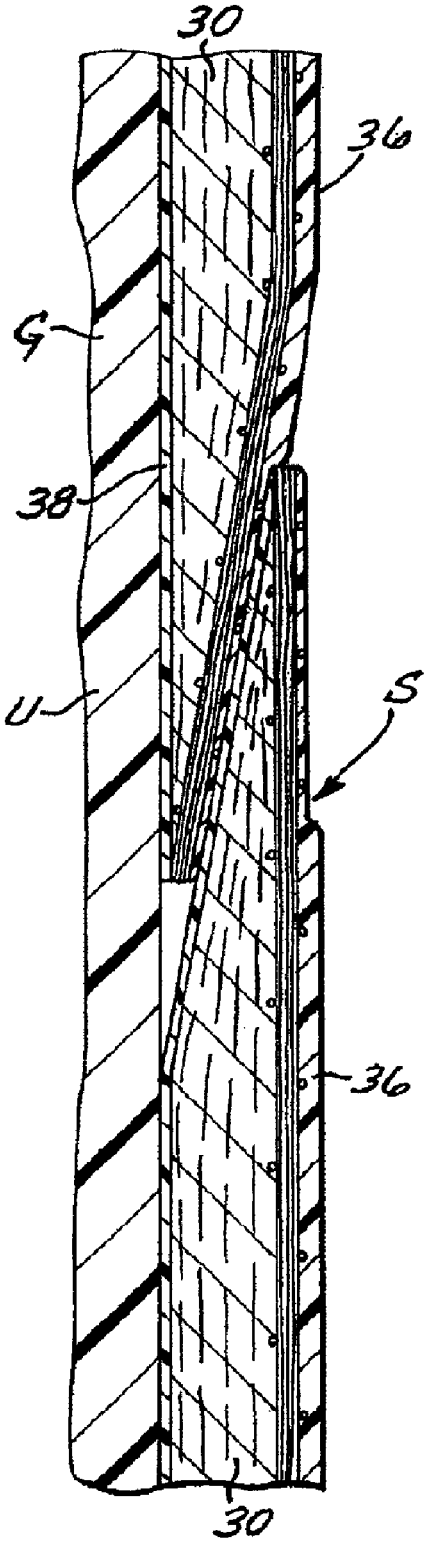
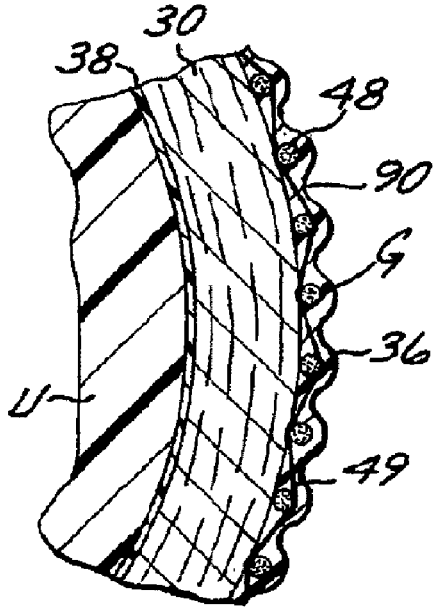
FIG. 24
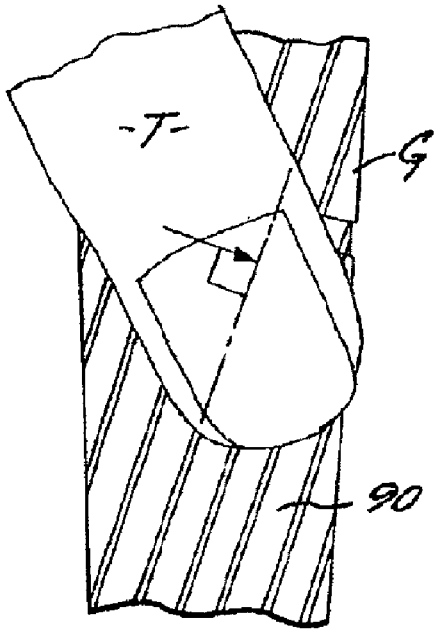
FIG. 25

METHOD OF MAKING AN ALL-WEATHER GRIP

RELATED U.S. APPLICATION DATA

This application is a continuation of U.S. patent application Ser. No. 10/785,379, filed Feb. 24, 2004, pending, which is a divisional of U.S. patent application Ser. No. 10/038,392, filed Jan. 2, 2002, now U.S. Pat. No. 6,695,713, which is a continuation-in-part of application Ser. No. 09/497,750, filed Feb. 4, 2000, now U.S. Pat. No. 6,386,989, and a continuation-in-part of application Ser. No. 09/705,376, filed Oct. 30, 2000, now abandoned, and a continuation-in-part of application Ser. No. 09/901,747 filed Jul. 9, 2001, now abandoned.

INCORPORATION BY REFERENCE

This application hereby incorporates by reference U.S. patent application Ser. Nos. 10/038,392, filed Jan. 2, 2002, and 10/785,379, filed Feb. 24, 2004, in their entireties.

BACKGROUND OF THE INVENTION

The present invention relates to an all-weather golf club grip for use under wet or dry playing conditions.

Applicant has previously developed resilient grips which successfully reduce shock to the muscle and arm joints of the users of golf clubs, tennis racquets, racquet ball racquets, baseball bats and other impact imparting devices. See, for example, U.S. Pat. No. 5,797,813 granted to applicant Aug. 25, 1998. Such earlier grips utilize a polyurethane layer bonded to a felt layer to define a strip which is spirally wrapped around the handle of a golf club, racquet or the like to conform to the external configuration or such handle. In certain of such grips the sides of the felt layer taper from the side edges of the strip and the polyurethane layer is formed with recessed reinforcement side edges which overlap to form a water retarding joint between the side edges of the strip as the strip is wrapped around the handle or over a resilient sleeve telescopically carried by the handle. A problem common to polyurethane-felt golf club grips is slippage of the grip when moisture accumulates thereon as from rainy or humid conditions. Such slippage results in diminished control of the golf club resulting in misdirected shots thereby reducing the enjoyment of the game to the golfer.

To reduce such slippage between a golf club grip and a golfer's hands there have been provided cord-type grips providing a roughened surface to the golfer's hands. Such cord-type grips however, feel stiff and uncomfortable to a golfer, particularly in dry weather conditions, although such grips afford reasonable slip-resistance between a golf club grip and a golfer's hands during wet playing conditions.

SUMMARY OF THE INVENTION

Applicant has developed a shock resistant golf club grip usable under either dry or wet playing conditions which provides improved resistance against slippage between a golfer's hands and the grip. Such golf club grip permits a golfer to continue playing even during rainy or humid conditions and also minimizes the slippage effect of perspiration build-up on the golf club grip. The grip utilizes a strip which is spirally wrapped about a golf club handle. The side edges of the grip are skived and are also formed with recessed side edges which are overlapped to define a water retarding joint along such side edges. Additionally, unraveling of the grip relative to the golf club handle or underlisting sleeve is inhibited by the skived side edges and recessed reinforcement edges. The recessed reinforcement side edges also inhibit interference with other golf clubs when one of the clubs is removed from or placed within a golf bag.

A golf club grip embodying the present invention utilizes a layer of felt which is adhered to a golf club handle or to an underlisting sleeve. The exterior side of the felt layer is secured to a layer made up of a mesh of fabric fibers. The felt layer and fabric mesh are bonded together and covered by polyurethane which impregnates the mesh, with fibers of the mesh forming grooves in the polyurethane, and with fibers of the mesh forming grooves in the polyurethane layer as the polyurethane cures. The surface of the polyurethane is buffed to partially expose the fabric fibers. When the golf club grip is installed on a golf club, a golfer grasps the outside layer of the grip with the surfaces of his hands in contact with the grooves of the polyurethane layer and the partially exposed fabric fibers. The friction provided by such grooves and partially exposed fabric fibers resist slippage of the golfer's hands on the grip, particularly-under wet or humid conditions such as exist during rain. In this manner, the golf club grip of the present invention provides maximum control of a golf club by a golfer under either wet or dry conditions. The grip is particularly adapted for use by low-handicap golfers, although the use thereof provides advantages for higher-handicap golfers. The provision of the non-slip contact between a golf club grip and a golfers hands is especially critical when the golfer takes a full swing of the golf club.

These and other features and advantages of the present invention will become apparent from the following detailed description of preferred embodiments which, taken in conjunction with the accompanying drawings, illustrates by way of example the principles of the invention.

BRIEF DESCRIPTION OF THE DRAWINGS

FIG. 1 is a top plan view of a sheet of a fabric mat sewn to the upper surface of a sheet of felt;

FIG. 2 is vertical sectional view taken along lines 2-2 of FIG. 1;

FIG. 3 is a further enlarged view of the encircled area designated 3 in FIG. 1;

FIG. 4 is a further enlarged view of the encircled area designated 4 in FIG. 2;

FIG. 9 is a fragmentary top plan view showing separate strip being cult from the panel;

FIG. 10 is a top plan view of a strip blank after its starting and trailing; edges have been formed;

FIG. 11 is a vertical sectional view showing recessed side edges being formed in a strip blank;

FIG. 12 is a fragmentary view showing the strip blank after such recessed side edges have been formed;

FIG. 13 is a side elevational view showing the strip blank after such recessed side edges have been formed;

FIG. 14 is a view of the strip blank similar to FIG. 13 showing the side edges of the felt layer after such side edges have been skived;

FIG. 23 is a side elevational view taken in enlarged scale along line 23-23 of FIG. 21;

FIG. 24 is a further enlarged horizontal sectional view taken along line 24-24 of FIG. 21;

FIG. 25 is a fragmentary view showing a golfer's thumb as such golfer holds a first form of a golf club grip embodying the present invention;

DETAILED DESCRIPTION OF THE PREFERRED EMBODIMENT

Figures 15, 16, 17, 18:
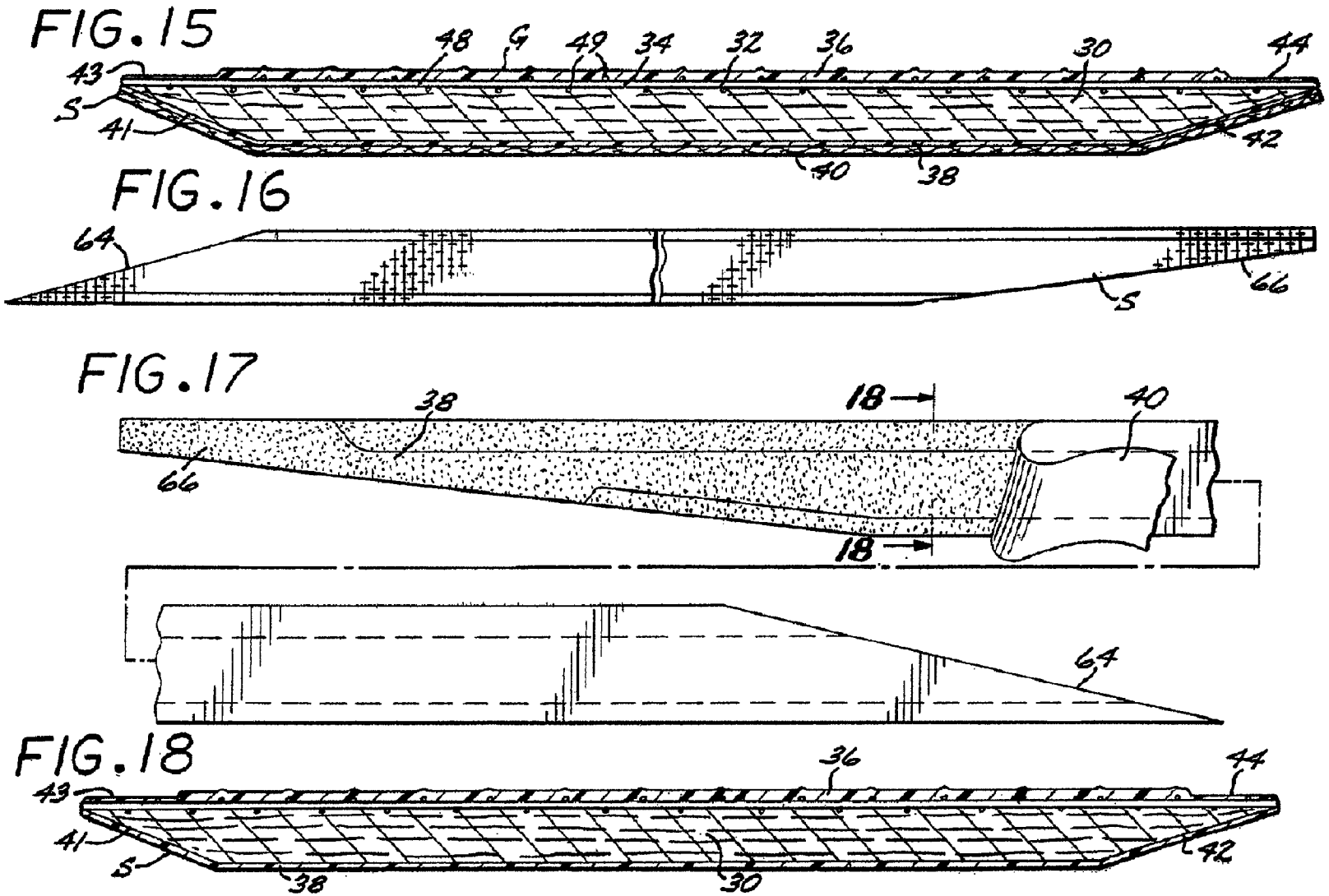
FIG. 15 is a cross-sectional view of the strip after an adhesive and a protective quick-release tape have been applied to the polyurethane layer.
FIG. 16 is a top plan view showing a completed strip formed in accordance with the present invention.
FIG. 17 is an enlarged view showing the protective tape being removed from the underside of the strip to expose the adhesive.
FIG. 18 is a side elevational view similar to FIG. 15 after the protective tape has been removed from the underside of the strip to expose the adhesive.
Figure 21:
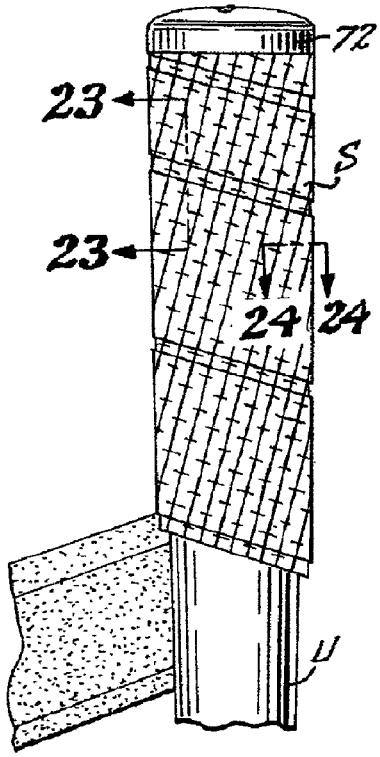
FIG. 21 is a fragmentary side elevational view showing a strip embodying the present invention being wrapped around the underlisting sleeve of FIGS. 19 and 20.
Figure 22:
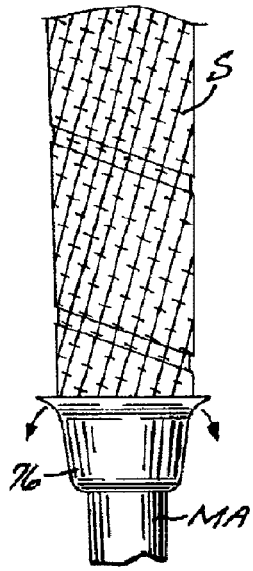
FIG. 22 is a fragmentary side elevational view showing the lower end of the strip being secured to the lower portion of the underlisting sleeve.

Referring-to the drawings a preferred golf club grip G embodying the present invention utilizes an elongated resilient strip S which is spirally wrapped around a golf club underlisting U as shown in FIGS. 21 and 22. Referring to FIGS. 15, 16 and 17, the strip S includes a felt layer 30 having its upper surface 32 bonded to a fabric mesh 34 by a synthetic plastic such as polyurethane layer 36. The bottom surface of the felt layer is covered by a pressure-sensitive adhesive 38 provided with a peel-away tape 40. The side edges of the felt layer are skived as shown at 41 and 42, and the side edges of the polyurethane layer are recessed as shown at 43 and 44.

More particularly, referring to FIGS. 1-4, the felt layer 30 is cut from an elongated felt mat FM disposed below an elongated fabric mesh mat MM. The front ends of mats FM and MM are initially attached together by a plurality of threads 46. The fabric mesh mat MM may be formed of longitudinally extending fibers 48 and transversely extending fibers 49. The longitudinally extending fibers 48 will preferably be of a larger diameter than the transversely extending fibers 49. For example, the longitudinal fibers may have a diameter of 0.4-0.75 mm and the transverse fibers have a diameter of 0.5-0.25 mm. However, the longitudinal and transverse fibers may be substantially equal in diameter. The fabric and felt mats may be fabricated of suitable materials such as nylon, cotton, polyester or the like.

Figure 5:
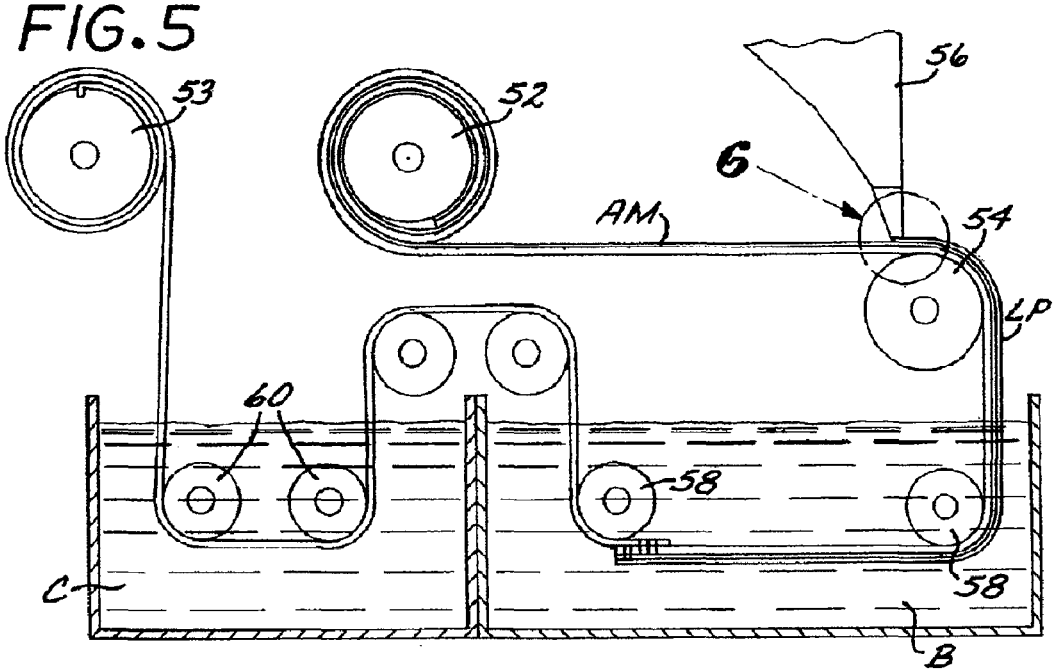
FIG. 5 is schematic side view showing the operation of applying a layer of polyurethane over the fabric mat.
Figure 6:
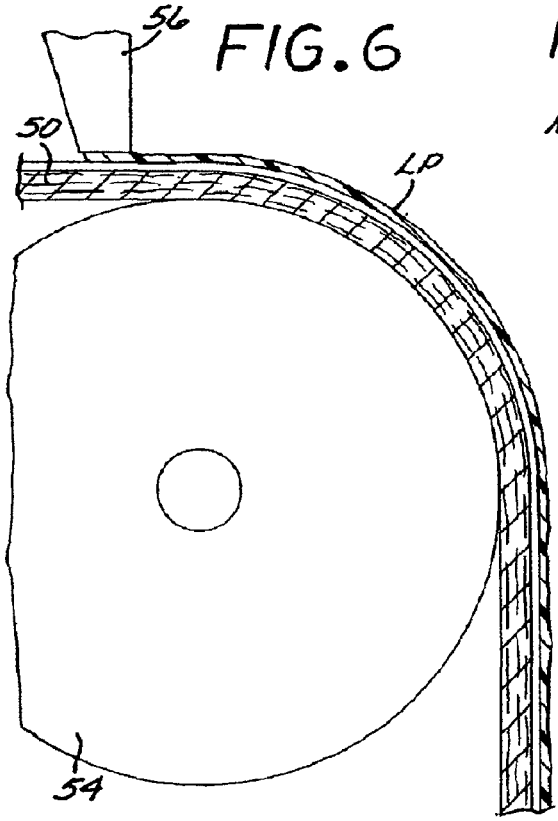
FIG. 6 is an enlarged view of the encircled area designated 6 in FIG. 5.
Figure 7:
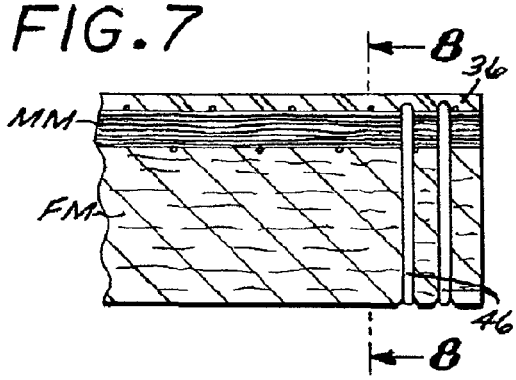
FIG. 7 is a fragmentary enlarged side elevational view showing a panel formed from the mat, the felt and the polyurethane.
Figure 8:
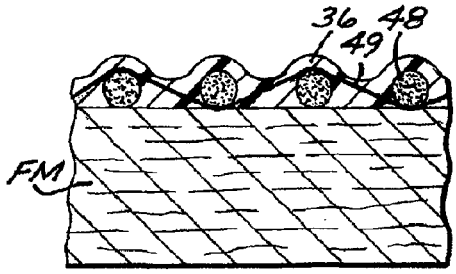
FIG. 8 is a further enlarged vertical sectional view taken along line 8-8 of FIG. 7.

Referring to FIGS. 5-8 there is shown a suitable arrangement for coating the attached together felt and fabric mats with liquid polyurethane. The attached-together mats AM are carried by a guiding cloth 50 secured to the front end of the mats from a supply roller 52 to a receiver roller 53. The guide cloth 50 extends over a coating roller 54 positioned below a polyurethane dispensing nozzle 56 with liquid polyurethane LP. The guiding cloth then moves the mats through water bath B over a plurality of rollers 58 so as to coagulate the liquid polyurethane. The thickness of the polyurethane layer should be sufficient to cover and impregnate the fibers of the mesh. The mats are then carried through a water cleaning bath C by rollers 60. The polyurethane serves to bond-together the felt layer and the mesh fibers. From the cleaning bath C the mats are wound upon a receiver roll 53. Referring to FIG. 8, it will be noted that the coarser fibers 48 of the fabric mesh serve to form parallel corrugations or grooves G in the outer surface of the cured polyurethane as the polyurethane 36 cures.

Referring now to FIGS. 9, 10 and 11, after the polyurethane coated fabric and felt mats FM have been removed from the receiver roll 53, they are cut into elongated strip blanks SB. Thereafter, as indicated in FIG. 10, the tongue ends of such blanks will be tapered to define starting and trailing ends 64 and 66 respectively.

Referring now to FIG. 12, the side edges of the polyurethane layer 36 are formed with the sidewardly and outwardly extending recessed reinforcement side edges 43 and 44 as by means of a pair of power-rotated heated rollers 68 and 67 which compress and therefore densify the side edges of the polyurethane layer, and fabric fillers embedded therein, as shown in FIG. 13. A suitable heated roller apparatus is disclosed in my U.S. Pat. No. 6,203,308. Alternatively, the recessed reinforcement side edges may be formed by heated platens as shown in my U.S. Pat. No. 5,797,813. In FIG. 14, the side edges of the felt layer 30 have been skived to form outwardly and upwardly slanted side edges 41 and 42. Referring now to FIGS. 15 and 16, the felt layer is then provided with an adhesive 38 initially covered in a conventional manner by a peel-away tape 40. Preferably, slanted skived side edge of the felt layer 30 will be shorter than the other slanted side edge 42.

Figure 19:
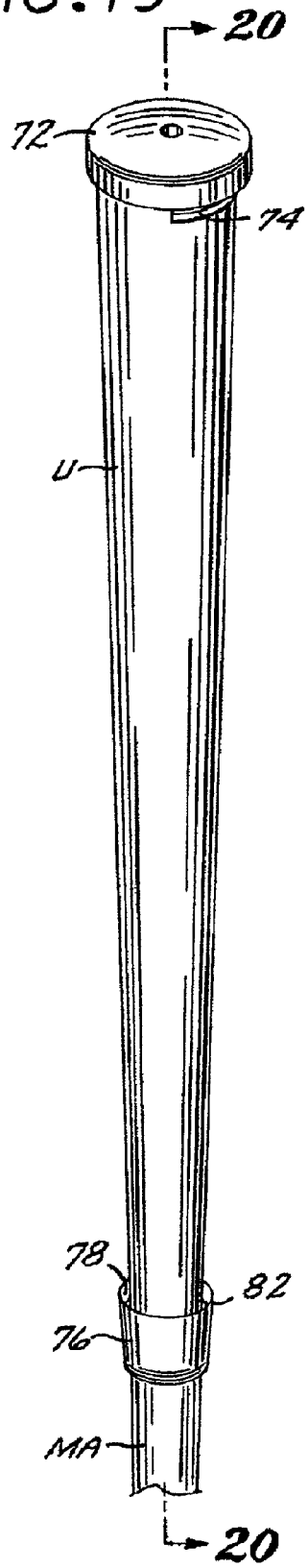
FIG. 19 is a perspective view of an underlisting sleeve which receives the completed strip to define a golf grip of the present invention.
Figure 20:
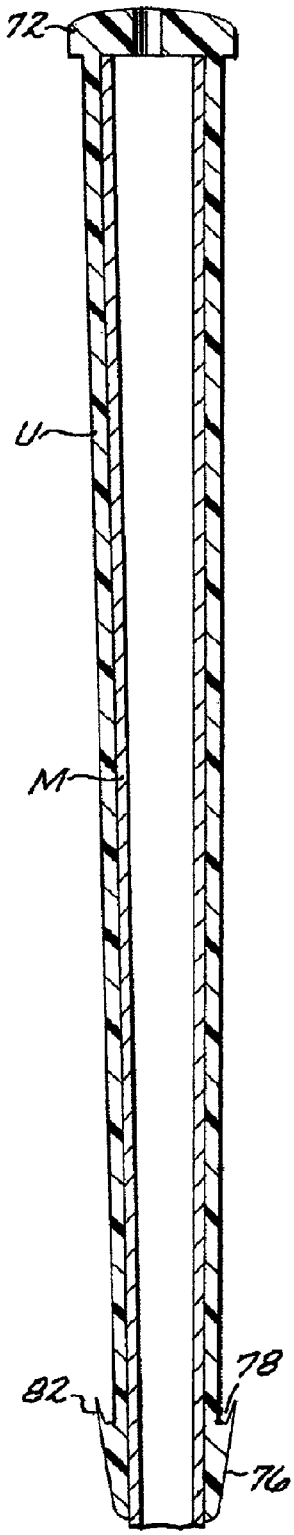
FIG. 20 is a vertical sectional view taken along line 20-20 of FIG. 19.

Referring now to FIGS. 19 and 20, there is shown a resilient rubber-like underlisting sleeve U which can be utilized in forming a slip-on grip of the present invention corresponding to underlisting sleeve U of my application Ser. No. 09/497,750 filed Feb. 4, 2000, now U.S. Pat. No. 6,386,989. Underlisting sleeve U is fabricated of synthetic plastic foam or rubber utilizing an integral cap 72. Below the cap 72 there is formed a groove 74 to receive the upper tip of the starting tongue end 66 of the strip S. The lower end of the sleeve is formed with an integral nipple 76. The upper portion of nipple 76 is provided with an upwardly-facing circumferential groove 78.

To apply the strip S to the underlisting sleeve U, the protective tape 40 is peeled off the adhesive 38, as indicated in FIG. 17. The strip S is then spirally wound around the underlisting sleeve U starting with the upper end of the strip and sleeve. The tip of the strip starting edge tongue 66 being first inserted in the groove 74 of the sleeve whereafter the strip is wrapped about one and one half times around the upper or butt end of the sleeve to provide a smooth configuration of the strip on the sleeve as shown in FIG. 21. With continued reference to FIG. 21 and additionally to FIG. 22, as the strip is wrapped around the underlisting sleeve U the underside of the recessed side edges 44 and 43 of the polyurethane layer overlap one another with such edges being secured together in a water-tight manner by adhesive 38. The provision of the skived side edges 41 and 42 of the felt layer 30 permits such overlapping of the recessed edges of the polyurethane layer. The use of slanted side edges 41 and 42 having different widths permits a more pleasing longitudinal profile of the completed grip while the narrower slanted edge 41 reduces the amount of felt cut-off the felt layer thereby maintaining the strength of the completed strip. It should be understood that the underlisting sleeve may be supported upon a suitable mandrel MA as the strip is wrapped therearound.

When the lower edge of the strip S has been spirally wound to a position wherein its lower edge is disposed in approximate horizontal alignment with the lower portion of nipple groove 78, the lower end portion of the strip is manually urged into the confines of the groove by temporarily expanding the peripheral lip 82 formed outwardly of the groove so as to admit the lower edge of the strip into the groove. When the lip 82 returns to its original position, such lip will securely retain the lower end of the strip within the nipple. The completed sleeve and strip combination may then be removed from the mandrel MA. Such sleeve and strip combination will define a preferred form of slip-resistant slip-on golf club grip embodying the present invention. It should be understood that the strip S may be sold separately from the underlisting sleeve U so as to provide a replacement for the strip originally supplied with the underlisting sleeve or for direct application to the butt end of a bare golf club handle.

Referring to FIGS. 23, 24 and 25, there is shown a first form of completed grip G embodying the present invention wherein the strip S has been adhered to the underlisting sleeve U. FIG. 23 shows in detail the relationship between the skived side edges of the felt layer 30 and the recessed reinforcement edges of the polyurethane layer 36 which provides a water-tight joint along the overlapped side edges of strip S. FIGS. 24 and 25 show the transversely extending grooves or corrugations 90 of the polyurethane layer, with FIG. 25 disclosing a golfer's thumb T contacting the grooved surface of the strip S as the golfer applies pressure to a golf club grip G of the present invention during a swing.

Referring now to FIGS. 26-34, there is shown apparatus for making a second form of grip G-2 embodying the present invention and the details of such second form of grip.

The second form of grip G-2 embodying the present invention is identical to the grip G of FIGS. 1-25 with the exception that the surface of the polyurethane 36' of strip S' is buffed or abraded to partially expose the fabric fibers 49'. The apparatus of FIGS. 26-29 is utilized to effect such buffing of the surface of the polyurethane 36' to partially expose the outer periphery of the fabric fibers 49'. The apparatus includes a buffing wheel 84 having sharp steel bristles 86 affixed to its outer periphery. A backing roller 87 is disposed below the buffing wheel 84. Buffing wheel 84 is rotated by an electric motor 88 to move a strip S' of the type shown in FIGS. 8, 9, and from right to left in FIG. 28, as indicated by the directional arrows. The speed at which the strip S' is moved under the rotating buffing wheel 84 is controlled by a conventional variable electric brake 87 coupled to drive rollers 88 and 89 at the desired RPM (preferably about 1800 RPM) through a chain drive 90.

Figure 26:
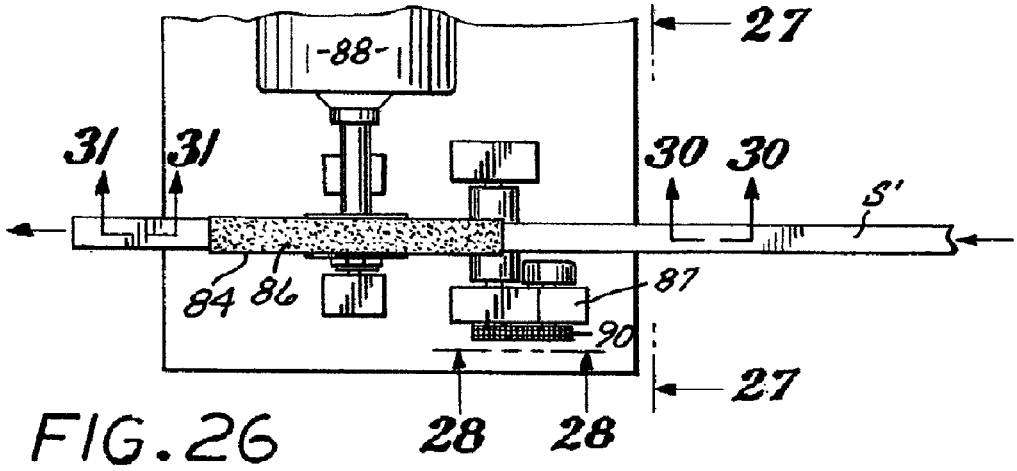
FIG. 26 is a broken top plan view showing apparatus for buffing the polyurethane surface of the grip shown in FIGS. 1-25 to partially expose the fabric fibers of such grip.
Figure 27:
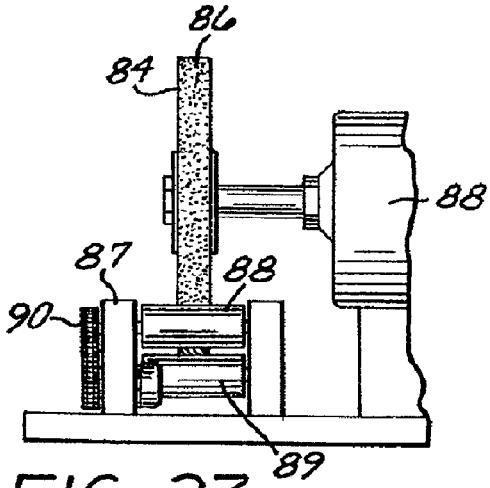
FIG. 27 is a vertical sectional view taken along line 27-27 of FIG. 26.
Figure 28:
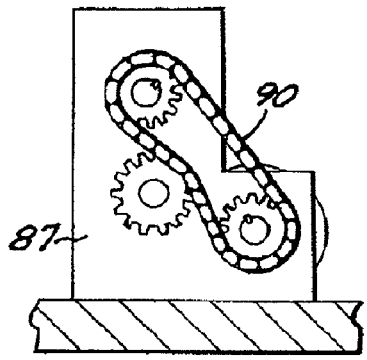
FIG. 28 is a broken side elevational view taken along the line 28-28 of FIG. 26.
Figure 29:
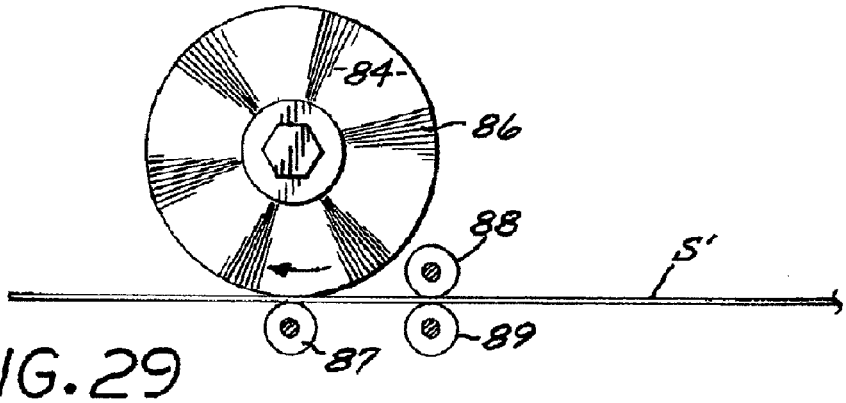
FIG. 29 is a partial side elevational view of the apparatus shown in FIG. 26.
Figure 30:
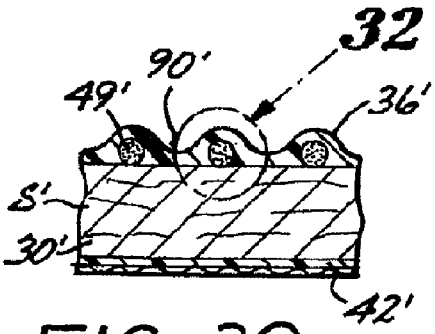
FIG. 30 is an enlarged vertical sectional view taken along line 30-30 of FIG. 26.
Figure 31:
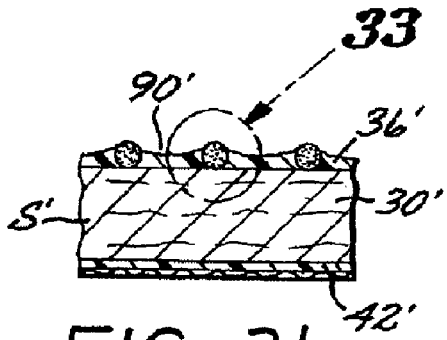
FIG. 31 is an enlarged vertical sectional view taken along line 31-31 of FIG. 26.
Figure 32:
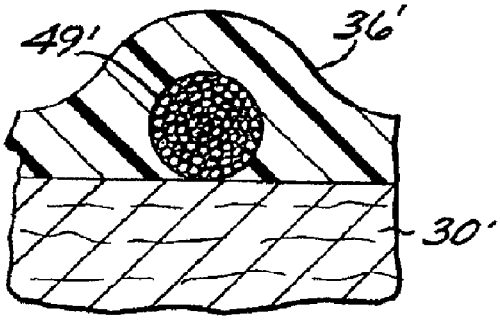
FIG. 32 is an enlarged view of the encircled area designated 32 in FIG. 30.
Figure 33:
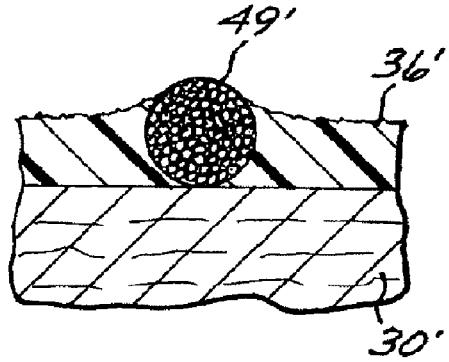
FIG. 33 is an enlarged view of the encircled area designated 33-33 in FIG. 31.
Figure 34:
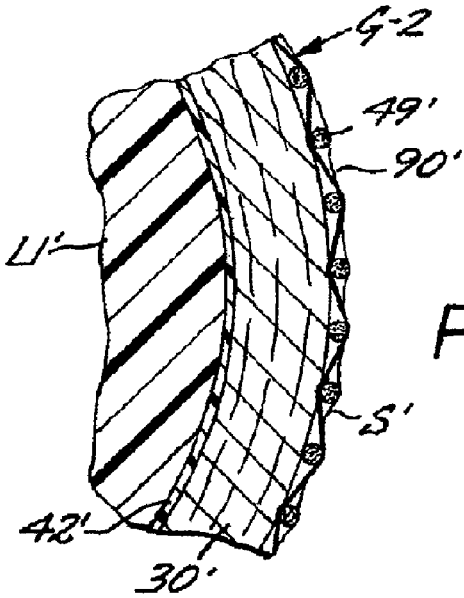
FIG. 34 is a view similar to FIG. 24 showing a completed second form of golf club grip embodying the present invention.

Referring additionally now to FIG. 30, the unbuffed strip S' is shown in its configuration of FIGS. 8, 9, and 10 as it is urged from the right to the left in FIGS. 26 and 29. When the strip engages the buffing wheel 84 the steel bristles 86 of the buffing wheel will abrade the surface of the polyurethane 36' to partially expose the outer periphery of the fabric fibers 49', as indicated in FIGS. 31 and 33. The strip S' is then cut into elongated strip blanks which tapered to define starting and trailing ends, skived side edges and the reinforcement side edges, as described hereinbefore with respect to the first form of strip S shown in FIGS. 1-25.

Finally, the strip S' is applied to an underlisting sleeve U' in the manner shown in FIGS. 21-24 so as to provide the second form of grip G-2 embodying the present invention. It is important to note that the partially exposed transversely extending fabric fibers 49' will cooperate with the transversely extending grooves 90' formed in the polyurethane layer so as to provide improved resistance against slippage of the golfer's hands on the grip G', particularly under wet or humid conditions such as exist during rain.

From the foregoing description it will be apparent that golf club grips embodying the present invention provides both the shock absorbing resilient qualities and tackiness of a polyurethane-felt grip and the non-slip characteristics of a conventional cord-type grip.

Various modifications can be made without departing from the spirit and scope of the present invention. Accordingly, it is not intended that the invention be limited, except by the appended claims.

What is claimed is:

1. A method of making a grip material, comprising the steps of:

providing a first fabric layer with an upper surface;

providing a second fabric layer with an upper surface and comprising a first set of substantially parallel fibers, and a second set of substantially parallel fibers;

overlapping said second fabric layer over said upper surface of said first fabric layer;

providing a liquid polyurethane;

applying said liquid polyurethane only to said upper surface of said second fabric layer such that said polyurethane covers said upper surface of said second fabric layer and contacts at least a portion of said upper surface of said first fabric layer; and coagulating said liquid polyurethane into a coagulated polyurethane layer to form a grip material wherein said coagulated polyurethane layer bonds said first fabric layer to said second fabric layer.

2. A method as set forth in claim 1, further comprising the step of providing a resilient base layer configured to be attached to the gripping portion of an impact imparting device.

3. A method as set forth in claim 2, further comprising the step of adhering said grip material to said resilient base layer.

4. A method as set for thin claim 3, further comprising the step of applying the combined grip material and resilient base layer to the gripping portion of an impact imparting device.

5. A method as set forth in claim 2, wherein said resilient base layer comprises a substantially enclosed cap portion, a nipple and a main portion extending therebetween, said cap portion defining a circumferential portion extending radially outwardly from said main portion.

6. A method as set forth in claim 5, further comprising the step of adhering said grip material to said main portion of said base layer wherein the outer surface of said grip material forms a generally smooth configuration with said circumferential portion.

7. A method as set forth in claim 1, further comprising the step of buffing at least a portion of said coagulated polyurethane layer such that at least a portion of said second fabric layer is exposed on an outer surface of said grip material.

* * * * *

UNITED STATES PATENT AND TRADEMARK OFFICE

CERTIFICATE OF CORRECTION

PATENT NO. : 7,985,314 B2
APPLICATION NO. : 12/123384
DATED : July 26, 2011
INVENTOR(S) : Ben Huang It is certified that error appears in the above-identified patent and that said Letters Patent is hereby corrected as shown below:

At Page 1 (coversheet), Item 60 (Related U.S. Application Data), line 4, please delete "and" and insert therefore, --which is--.

At Page 1 (coversheet), Item 60 (Related U.S. Application Data), line 8, please delete "which is" and insert therefore, --and--.

At column 1, line 7, please delete "pending, which" and insert therefore, --which--.

At column 2, line 21, please delete "particularly-under" and insert therefore, --particularly under--.

At column 2, line 28, please delete "golfers" and insert therefore, --golfer's--.

At column 2, line 40, please delete "is" and insert therefore, --is a--.

At column 2, line 56, please delete "cult" and insert therefore, --cut--.

At column 2, line 58, please delete "trailing;" and insert therefore, --trailing--.

At column 3, line 54, please delete "Referring-to" and insert therefore, --Referring to--.

At column 4, line 62, please delete "of" and insert therefore, --of the--.

At column 5, line 51, please delete "shown" and insert therefore, --shown an--.

At column 6, line 58, please delete "set for thin" and insert therefore, --set forth in--.

Signed and Sealed this
Seventh Day of February, 2012

David J. Kappos

David J. Kappos
*Director of the United States Patent and Trademark Office*